US010386157B2

(12) United States Patent
Plummer

(10) Patent No.: US 10,386,157 B2
(45) Date of Patent: Aug. 20, 2019

(54) ILLUMINATED SIGHT SYSTEM

(71) Applicant: Scott Plummer, Woodstock, CT (US)

(72) Inventor: Scott Plummer, Woodstock, CT (US)

(73) Assignee: BrightSight LLC, Woodstock, CT (US)

( * ) Notice: Subject to any disclaimer, the term of this patent is extended or adjusted under 35 U.S.C. 154(b) by 377 days.

(21) Appl. No.: 15/219,470

(22) Filed: Jul. 26, 2016

(65) Prior Publication Data

US 2017/0146318 A1 May 25, 2017

Related U.S. Application Data

(60) Provisional application No. 62/282,128, filed on Jul. 27, 2015.

(51) Int. Cl.

| | |
|---|---|
| ***F41G 1/34*** | (2006.01) |
| ***F41G 1/01*** | (2006.01) |
| ***F41G 1/033*** | (2006.01) |
| ***F41G 1/08*** | (2006.01) |
| ***F41G 1/16*** | (2006.01) |
| ***F41G 11/00*** | (2006.01) |

(52) U.S. Cl.

CPC ..... *F41G 1/345* (2013.01); *F41G 1/01* (2013.01); *F41G 1/033* (2013.01); *F41G 1/08* (2013.01); *F41G 1/16* (2013.01); *F41G 11/003* (2013.01)

(58) Field of Classification Search

CPC . F41G 1/345; F41G 1/01; F41G 1/033; F41G 1/08; F41G 1/16; F41G 11/003

USPC ..... 42/132

See application file for complete search history.

(56) References Cited

U.S. PATENT DOCUMENTS

| | | | | | |
|---|---|---|---|---|---|
| 4,434,560 | A * | 3/1984 | Comeyne | F41G 1/345 | 42/114 |
| 5,533,292 | A * | 7/1996 | Swan | F41G 1/16 | 42/123 |
| 6,058,615 | A * | 5/2000 | Uhlmann | F41G 1/01 | 42/132 |
| 6,412,208 | B1 * | 7/2002 | Mikuta | F41G 1/345 | 42/132 |
| 6,571,504 | B2 * | 6/2003 | Carlson | F41G 1/345 | 42/132 |
| 7,225,578 | B2 * | 6/2007 | Tai | F41G 1/30 | 33/334 |
| 7,356,962 | B2 * | 4/2008 | Swan | F41G 1/065 | 42/133 |
| 8,015,744 | B1 * | 9/2011 | Swan | F41G 1/065 | 42/133 |

(Continued)

*Primary Examiner* — Joshua E Freeman
*Assistant Examiner* — Bridget A Cochran
(74) *Attorney, Agent, or Firm* — U Conn IP Law Clinic; Chantelle Ankerman

(57) ABSTRACT

An illuminated sighting system is provided and includes a front sight and a rear sight, wherein the front sight includes a front aperture and a front base, wherein, the front aperture further includes a front LED and a front sight post wherein the front sight post is adjustable in height and is optically communicated with the front LED such that when the front LED is illuminated, at least a portion of the front sight post is illuminated and wherein, the rear aperture further includes a sighting halo and a rear LED wherein the sighting halo is laterally adjustable and associated with the rear LED such that when the rear LED is illuminated, at least a portion of the sighting halo is illuminated.

10 Claims, 18 Drawing Sheets

(56) References Cited

U.S. PATENT DOCUMENTS

| | | | | |
|---|---|---|---|---|
| 8,191,302 | B1 * | 6/2012 | Swan | F41G 1/04 362/110 |
| 8,484,882 | B2 | 7/2013 | Haley | |
| 9,250,035 | B2 * | 2/2016 | Sullivan | F41G 11/003 |
| 9,448,035 | B2 * | 9/2016 | Wilson | F41G 11/003 |
| 2003/0140546 | A1 * | 7/2003 | Kay | F41G 1/033 42/133 |
| 2011/0173871 | A1 * | 7/2011 | Moore | F41G 1/35 42/114 |
| 2012/0180368 | A1 * | 7/2012 | Haley | F41G 1/02 42/132 |
| 2012/0180370 | A1 * | 7/2012 | McKinley | F41G 1/02 42/146 |

* cited by examiner

ILLUMINATED SIGHT SYSTEM

CROSS-REFERENCE TO RELATED APPLICATIONS

This application is related to and claims the benefit of priority to U.S. Provisional Patent Application Ser. No. 62/282,128, filed on Jul. 27, 2015, the contents of which are incorporated herein by reference in its entirety.

FIELD OF THE INVENTION

The present invention is generally directed to a sighting system for a weapon and other article, and more particularly to an illuminated sighting system for a weapon.

BACKGROUND OF THE INVENTION

Sighting systems for rifles and other devices are well known in the art and typically include mechanical components. Known mechanical bore sights typically utilize a first upstanding member located at the far end, or muzzle end, of the weapon being aimed and a second upstanding member located at the close end, or receiver end, of the weapon, near the operator's eye. To use the sight and hit the intended target, the operator visually sights down the length of the barrel of the weapon, aligning the tops of the two members with the desired target. Usually the two members are of equivalent height and one or both are laterally and vertically adjustable, so that the sight can be accurately calibrated for the particular operator. Operators may also use the mechanical bore sight in conjunction with an optical Red Dot scope. The scope is mounted onto the upper surface of the weapon between the close end bore sight and the operator and is sometimes equipped with magnification. The bore sights are usually the same height as the aperture in the Red Dot scope, which enables co-witnessing or lining up of the target. Together, the bore sight and Red Dot systems enable an operator to more effectively aim the weapon.

Unfortunately however, these features are not very effective in low light situations. And although flashlights or lasers mounted to the weapon may help an operator to aim in low light, they also give away the operator's position exposing the operator a making them a target. Also, traditional bore sights typically have a tritium coating to illuminate the sights and help the operator in lining up the target. Unfortunately, the tritium coatings require charging before use and eventually degrade with time and recharging

SUMMARY OF THE INVENTION

An illuminated sighting system is provided and includes a front sight having a front aperture and a front base, wherein, the front aperture includes a front connector pad, a front LED, a front sight post and an aperture body defining an aperture cavity, wherein the front connector pad is electrically connected to the front LED and wherein the front LED is located within the aperture cavity and wherein the front sight post is movably associated with the aperture body to be adjustable in height and to be optically communicated with the front LED such that when the front LED is illuminated, at least a portion of the front sight post is illuminated, and wherein, the front base includes a front base structure having a front base connector pad and defining a front base cavity for containing front base power and control circuitry, wherein the front base connector pad is electrically connected to the front base power and control circuitry wherein the front sight is configurable between a first configuration and a second configuration, and wherein when the front sight is in the first configuration the front aperture is in a stowed position and when the front sight is in the second configuration the front aperture is in an unstowed configuration and the front connector pad is contacting the front base connector pad; and wherein, the rear aperture includes a rear connector pad, a rear LED, a rear aperture body and a rear sight reticle defining a reticle cavity and having a sighting halo, wherein the rear connector pad is electrically connected to the rear LED and wherein the rear LED is located within the reticle cavity and wherein the rear sight reticle is movably associated with the aperture body to be laterally adjustable and to be optically communicated with the rear LED such that when the rear LED is illuminated, at least a portion of the sighting halo is illuminated, and wherein, the rear base includes a rear base structure having a rear base connector pad and defining a rear base cavity for containing rear base power and control circuitry, wherein the rear base connector pad is electrically connected to the rear base power and control circuitry, wherein the rear sight is configurable between a first configuration and a second configuration, and wherein when the rear sight is in the first configuration the rear aperture is in a stowed position and when the rear sight is in the second configuration the rear aperture is in an unstowed configuration and the rear connector pad is contacting the rear base connector pad.

An illuminated sighting system is provided and includes a front sight having a front aperture and a front base, wherein, the front aperture includes a front connector pad, a front LED, a front sight post and an aperture body defining an aperture cavity, wherein the front connector pad is electrically connected to the front LED and wherein the front LED is associated with the front sight post such that when the front LED is illuminated, at least a portion of the front sight post is illuminated, and wherein, the front base includes a front base structure having a front base connector pad and defining a front base cavity for containing front base power and control circuitry, wherein the front base connector pad is electrically connected to the power and control circuitry, wherein the front sight is configurable between a first configuration and a second configuration, and wherein when the front sight is in the first configuration the front aperture is in a stowed position and when the front sight is in the second configuration the front aperture is in an unstowed configuration; and wherein, the rear aperture includes a rear connector pad, a rear LED, a rear aperture body and a rear sight reticle defining a reticle cavity and having a sighting halo, wherein the rear connector pad is electrically connected to the rear LED and wherein the rear LED is associated with the rear sight reticle such that when the rear LED is illuminated, at least a portion of the sighting halo is illuminated, and wherein, the rear base includes a rear base structure having a rear base connector pad and defining a rear base cavity for containing rear base power and control circuitry components, wherein the rear base connector pad is electrically connected to the power components, wherein the rear sight is configurable between a first configuration and a second configuration, and wherein when the rear sight is in the first configuration the rear aperture is in a stowed position and when the rear sight is in the second configuration the rear aperture is in an unstowed configuration.

One embodiment of the present invention is summarized in that illuminated front and rear sights include a body member having a cavity defined therein, mounting means attached to the body member for mounting the sight, a battery received in the cavity in the body member, or off to the side, depending upon the amount of power needed, and a light-emitting diode mounted on the sight, the light-emitting diode being electrically connected to the battery to enable the operator aiming in low or no light and, if needed, an ambient light sensor to control an auto-on function. In one embodiment, a pin assembly is provided to selectively connect or disconnect the battery to the light emitting diode and computer chip controlling light intensity and accelerometer monitoring for battery conservation.

In another embodiment, the invention may be configured for mounting on existing weapons, but may also be integrated into a weapon design. It is an object of the present invention to provide an illuminated sight that allows an operator to sight his target in low or no light conditions. It is another object of the present invention to provide an illuminated sight in which the light used is switchable on or off at the convenience of the operator, or may be adjustably programmed to deactivate after a period of inactivity detected by an accelerometer. It is another object of the present invention to provide an illuminated sight with a minimum of wiring and/or connectors, both to minimize device assembly and overall cost, and to maximize reliability. It is an advantage of the illuminated sight of the present invention that the light source used by the operator is relatively inconspicuous, and although visible to the operator, is invisible from the target side of the sight. It is another advantage of the invention that the front and rear sights are low profile, self-aligning and flip-up. The present invention sighting device folds downwardly against a mounting rail either directly on the weapon, onto a receiver sleeve mounting area or other desirable location, thereby keeping the sighting device within the weapon's contour during non-use and streamlining its profile. The sighting device is spring-loaded and flips into an operational position with the release of a locking pin. Further, the present invention self-aligns as it moves into an operational position, thereby providing accurate and consistent aiming while eliminating the need for re-alignment each time the sight is deployed. Also, when the front or rear sights are in the folded position, the spring-loaded contact pins do not come in contact with the female contact assemblies therefore current is not allowed to flow and the LED does not illuminate, nor does the CPU initiate the timing process to illuminate the LED for a set period of time. When the front and rear sights are released to their upright position perpendicular to the mounting site, the male spring-loaded pins come into contact with the female contact assemblies and current flows to the LED and CPU.

BRIEF DESCRIPTION OF THE DRAWINGS

The foregoing and other features and advantages of the present invention will be more fully understood from the following detailed description of illustrative embodiments, taken in conjunction with the accompanying drawings in which like elements are numbered alike in the several Figures.

DETAILED DESCRIPTION

Figure 1A:
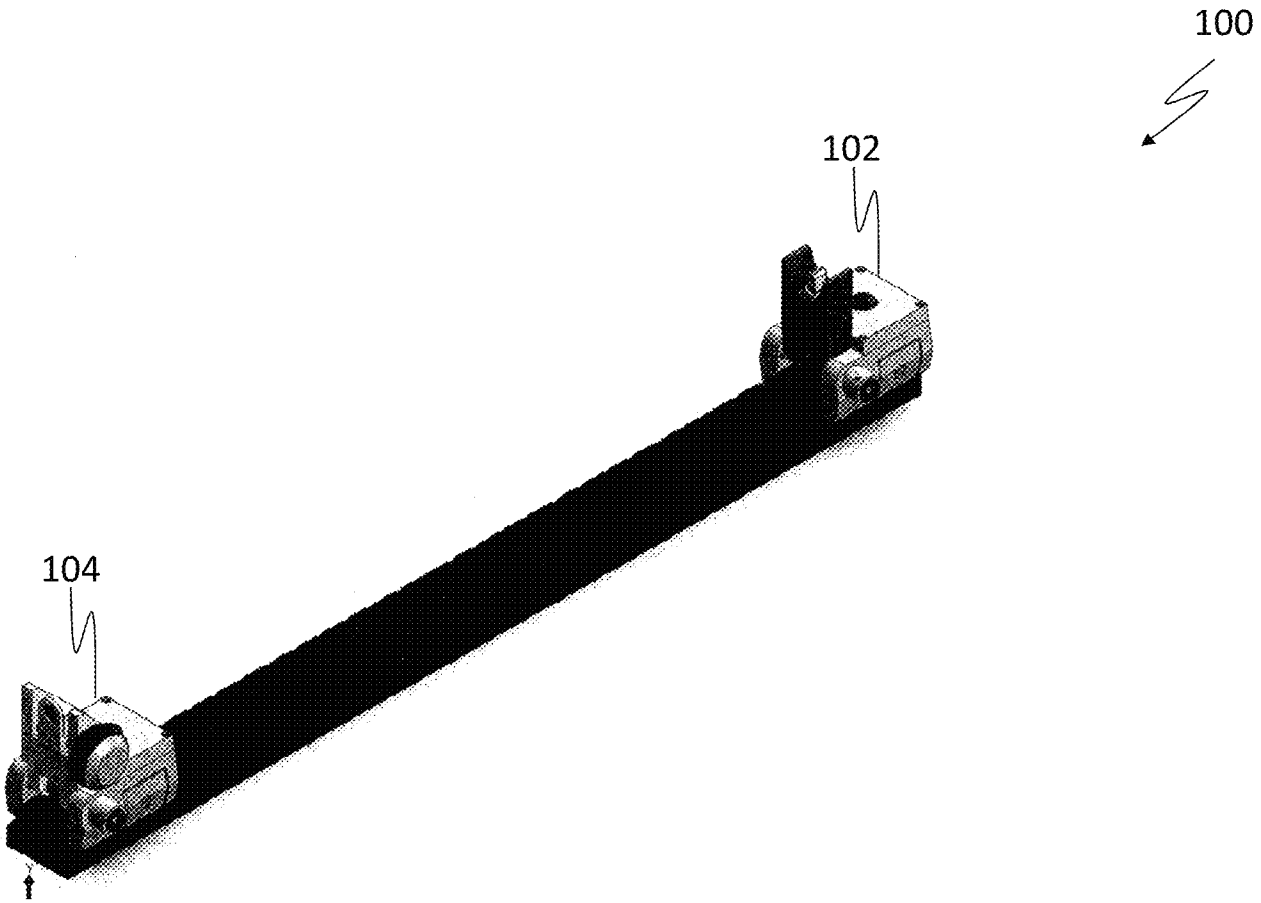
FIG. 1A shows a front side perspective view of an illuminated sighting system associated with a mounting rail for a weapon, in accordance with one embodiment of the invention.
Figure 1B:
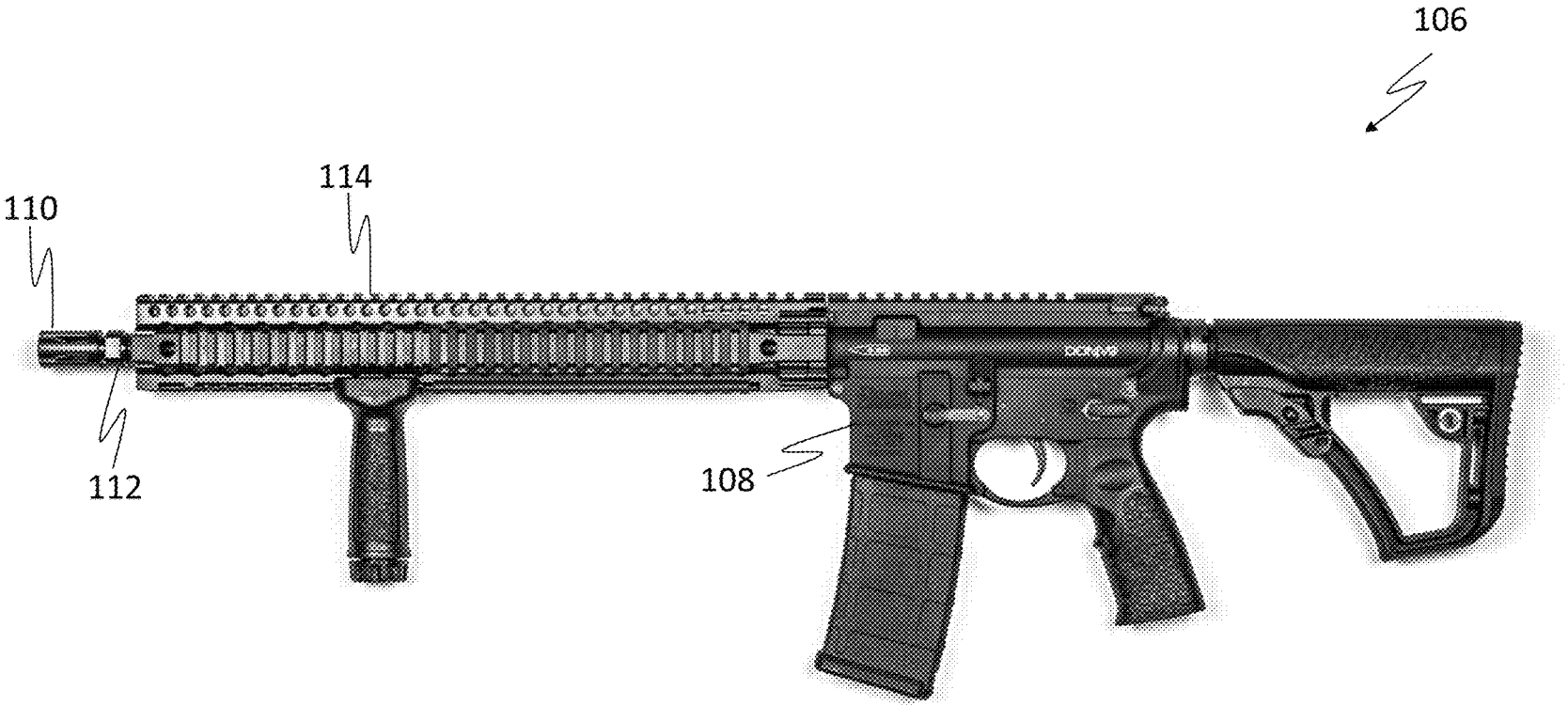
FIG. 1B Prior Art
FIG. 1B shows a side view of a weapon configured to associate with the mounting rail of FIG. 1A, in accordance with the prior art.
Figure 1C:
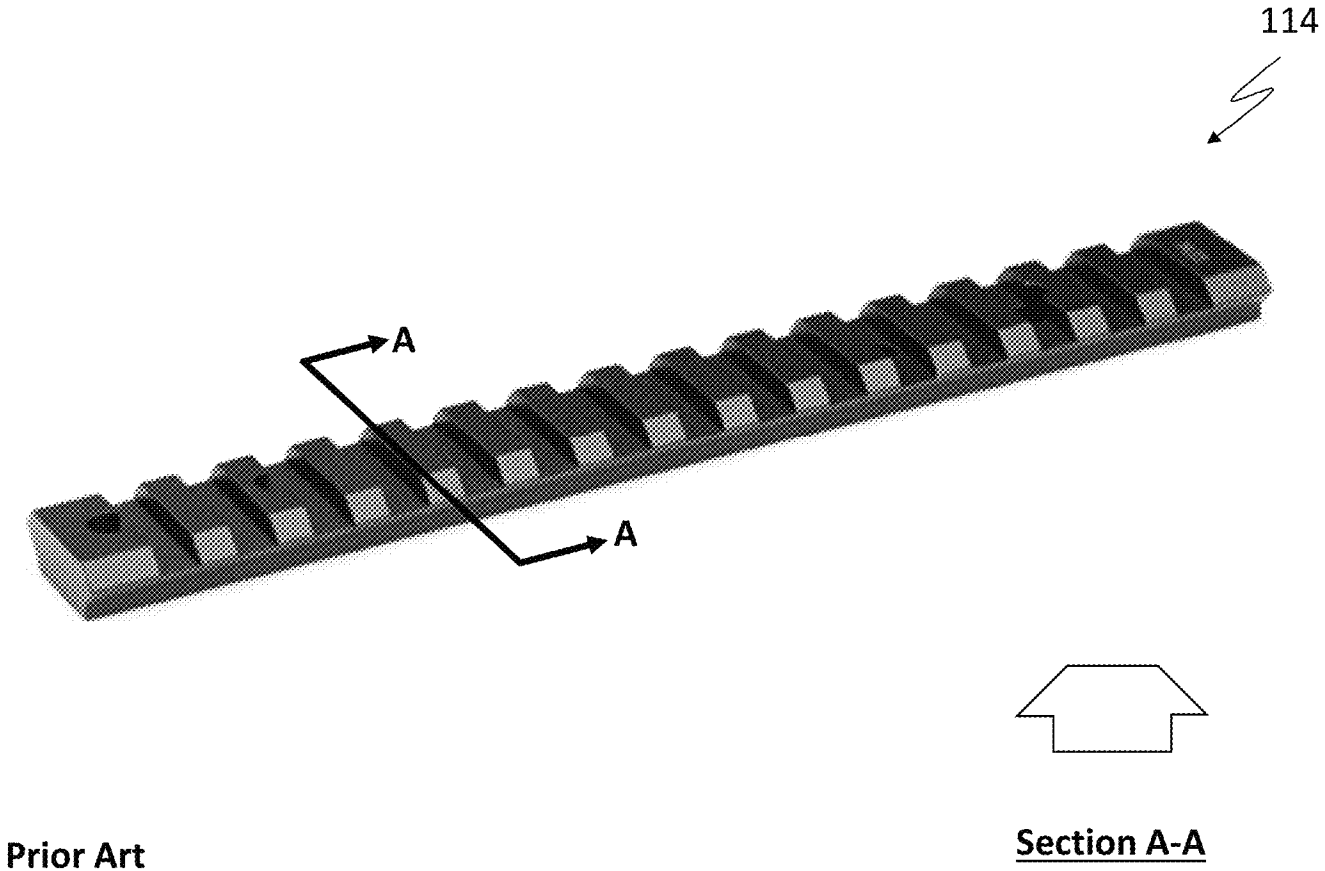
Prior Art FIG. 1C
FIG. 1C shows a side view of the mounting rail of FIG. 1A, in accordance with the prior art.
Figure 2A:
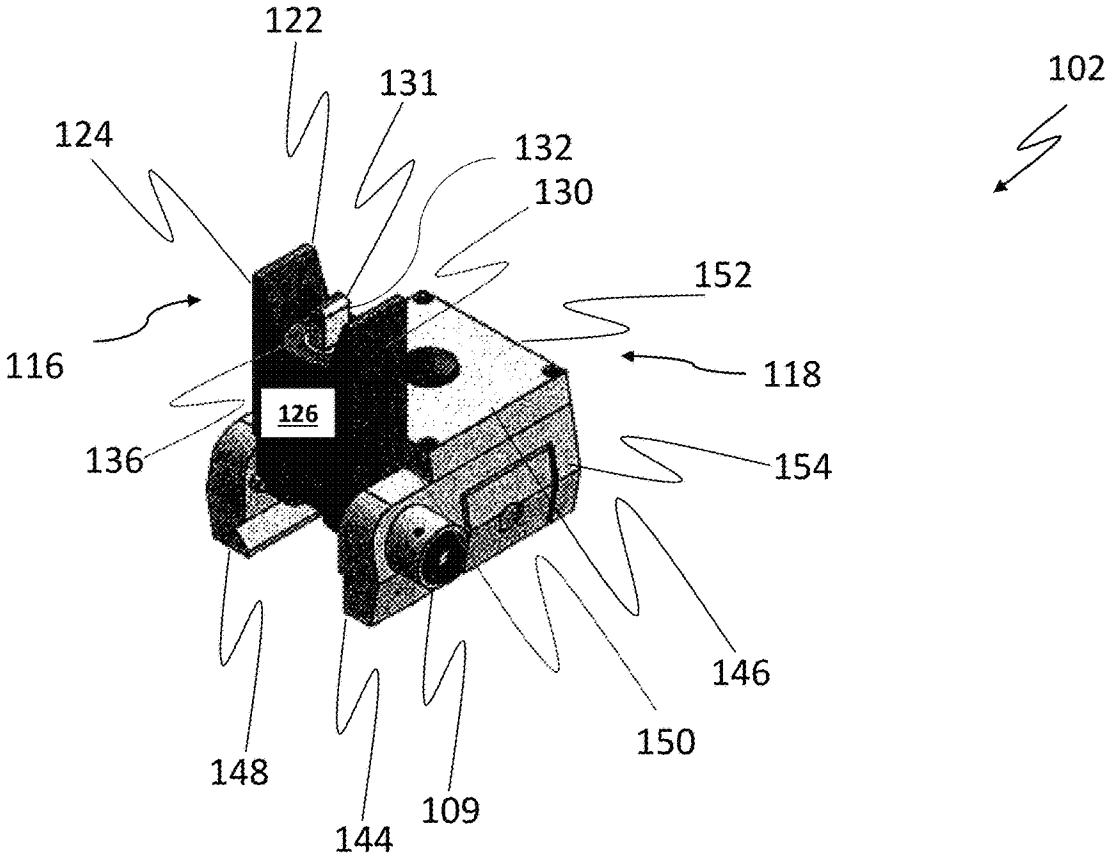
FIG. 2A shows a top-down front-side view of the front sight assembly of the illuminated sighting system of FIG. 1A, in accordance with one embodiment of the invention.
Figure 2B:
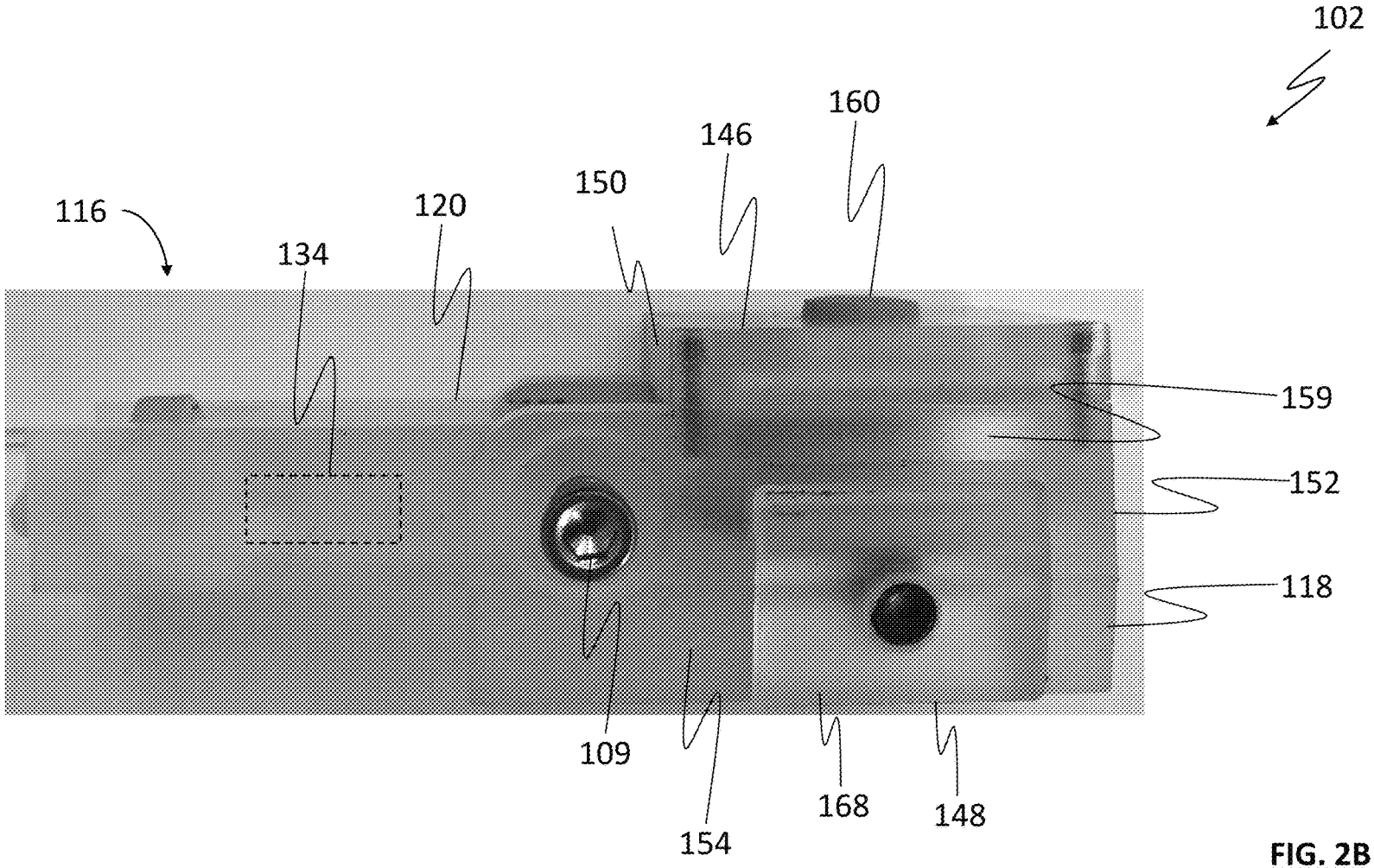
FIG. 2B shows a side view of the front sight assembly of FIG. 2A.
Figure 2C:
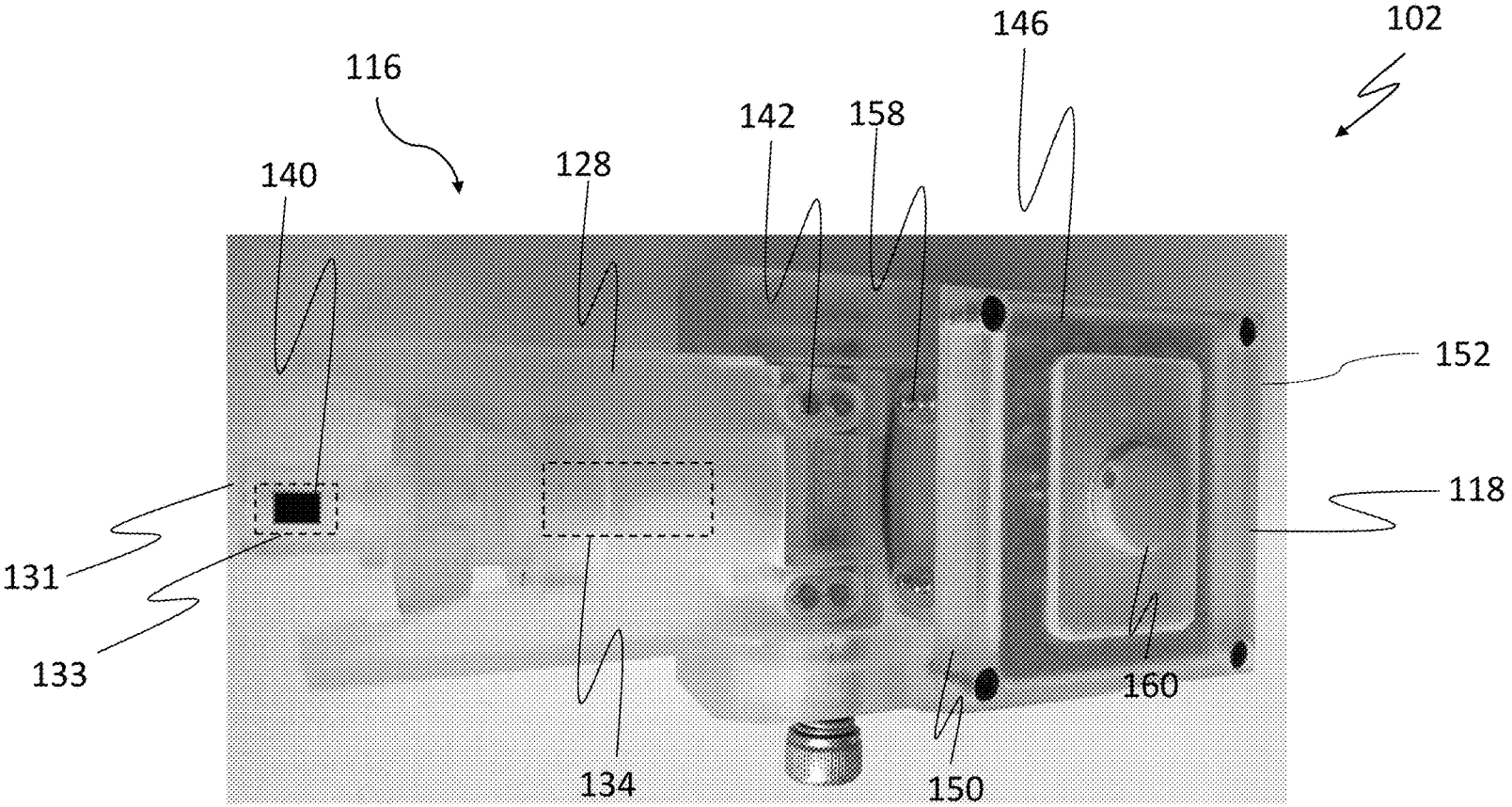
FIG. 2C shows a top down view of the front sight assembly of FIG. 2A.
Figure 2D:
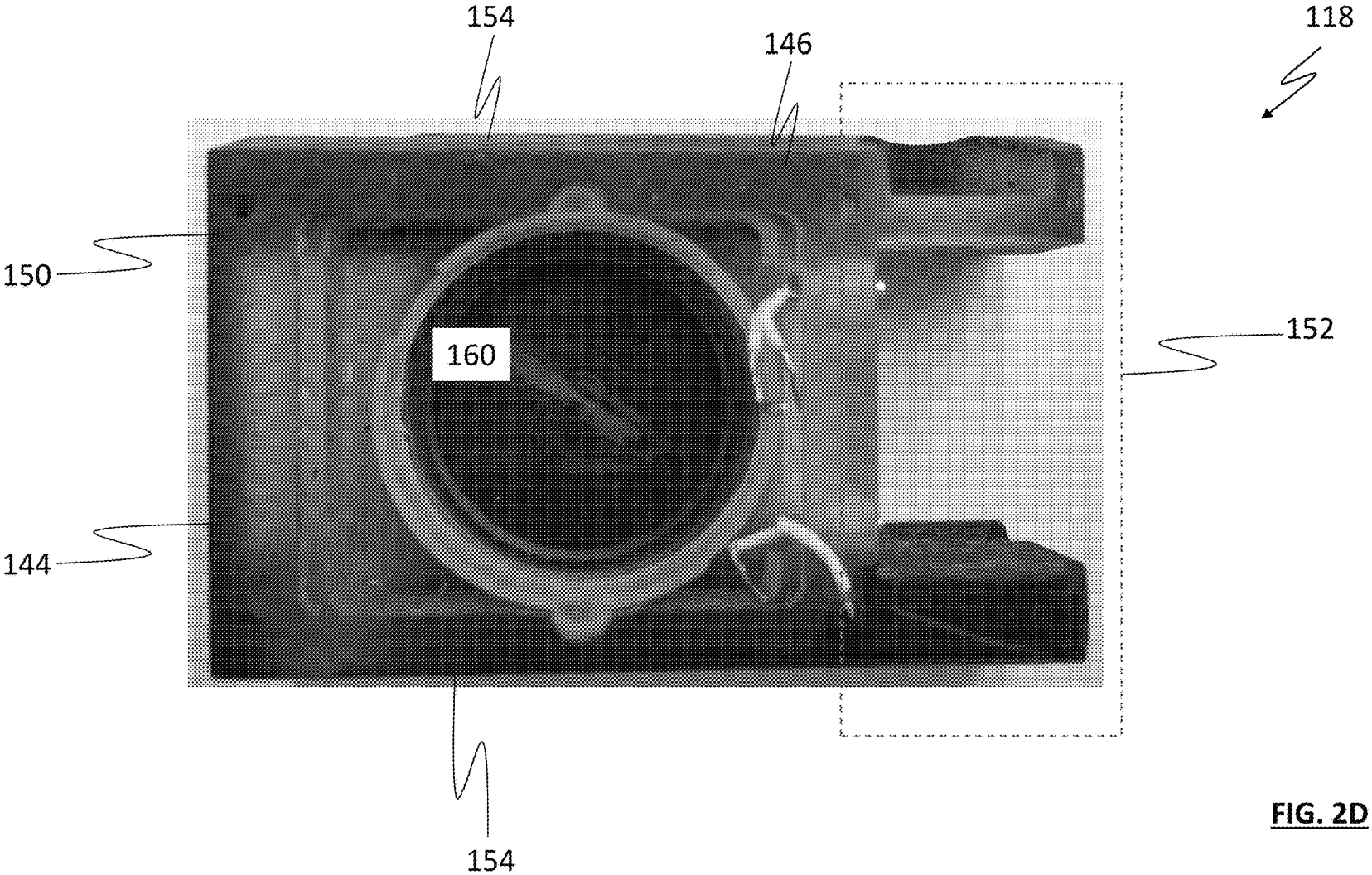
FIG. 2D shows a top down view of the front base of the front sight assembly of FIG. 2A.
Figure 2E:
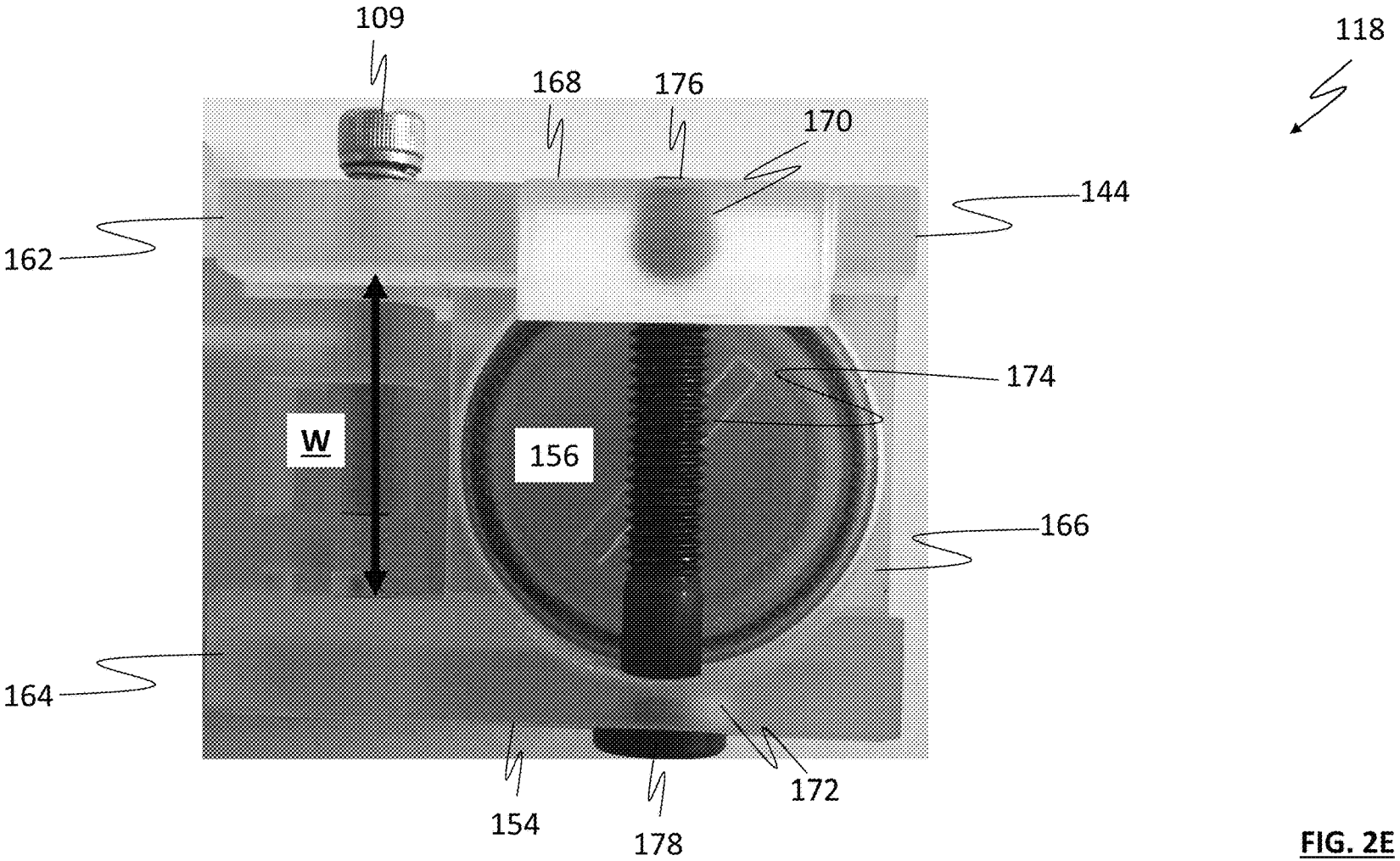
FIG. 2E shows a bottom up view of the front base of the front sight assembly of FIG. 2A.
Figure 2F:
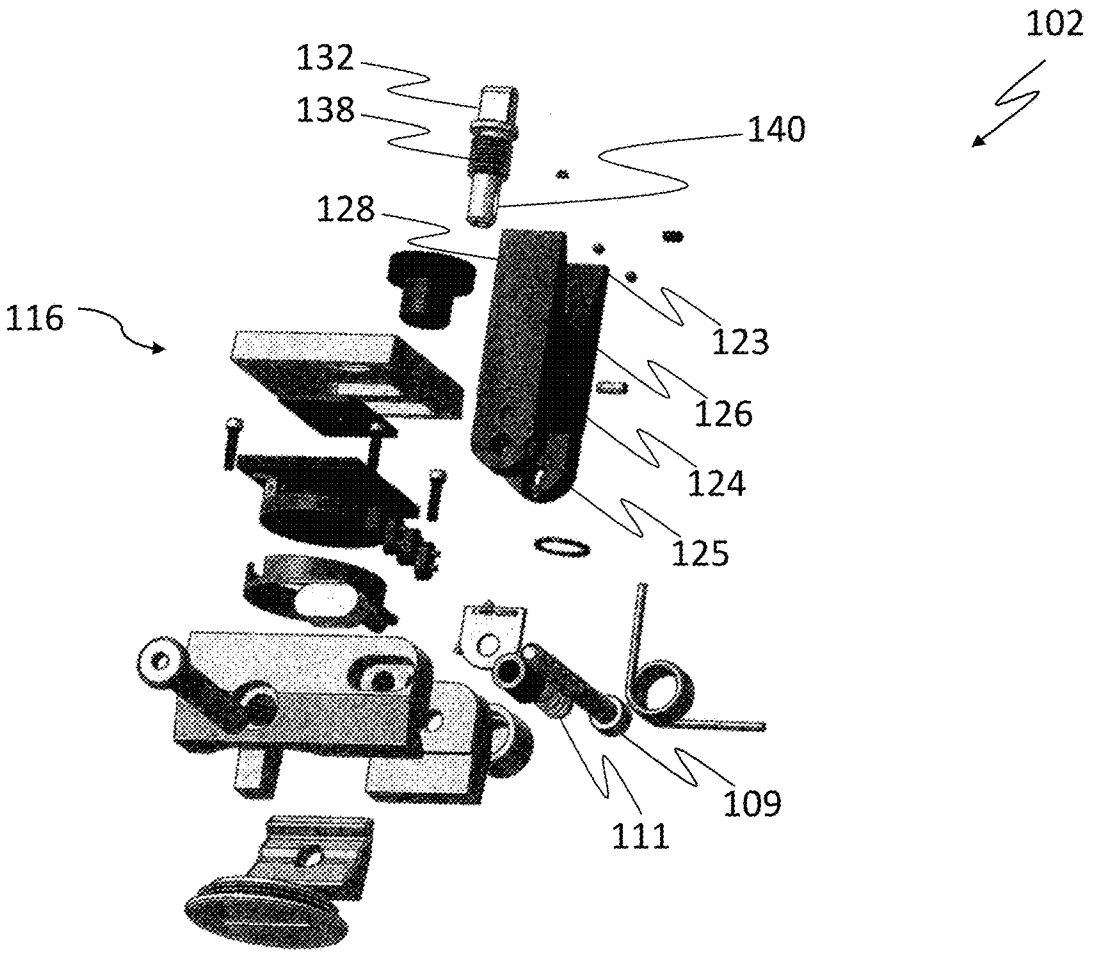
FIG. 2F shows an exploded view of the front sight assembly of FIG. 2A.
Figure 3A:
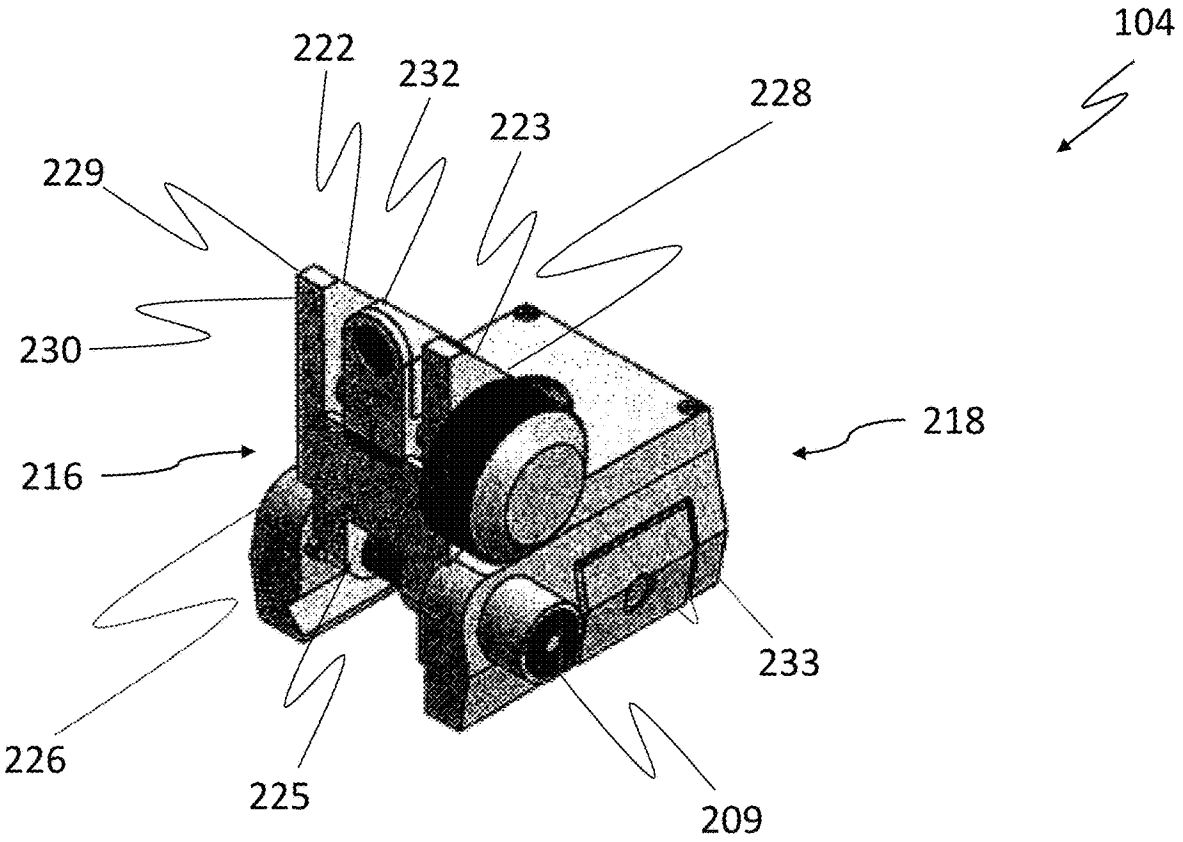
FIG. 3A shows a top-down front-side view of the rear sight assembly of the illuminated sighting system of FIG. 1A, in accordance with one embodiment of the invention.
Figure 3B:
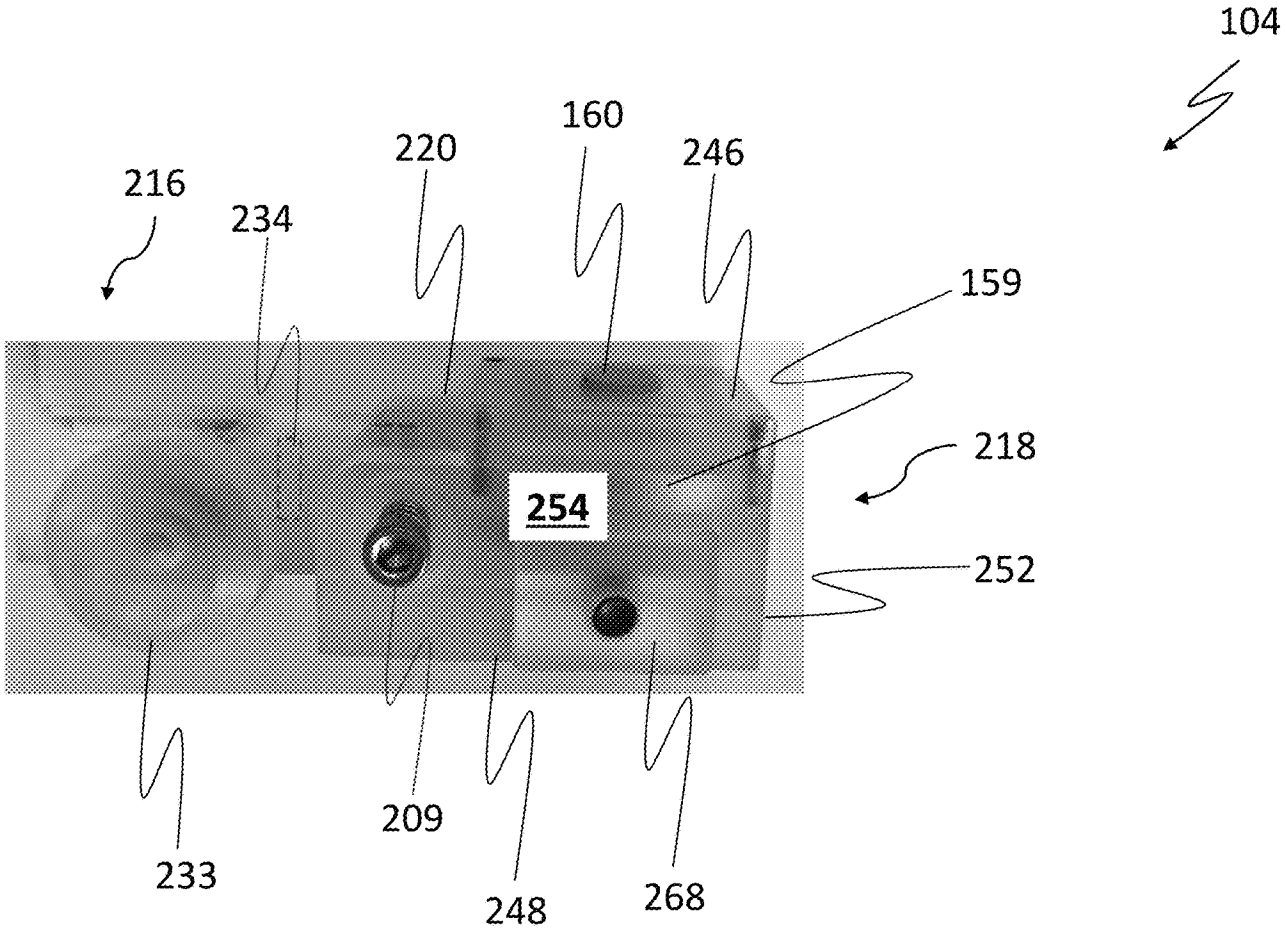
FIG. 3B shows a side view of the rear sight assembly of FIG. 3A.
Figure 3C:
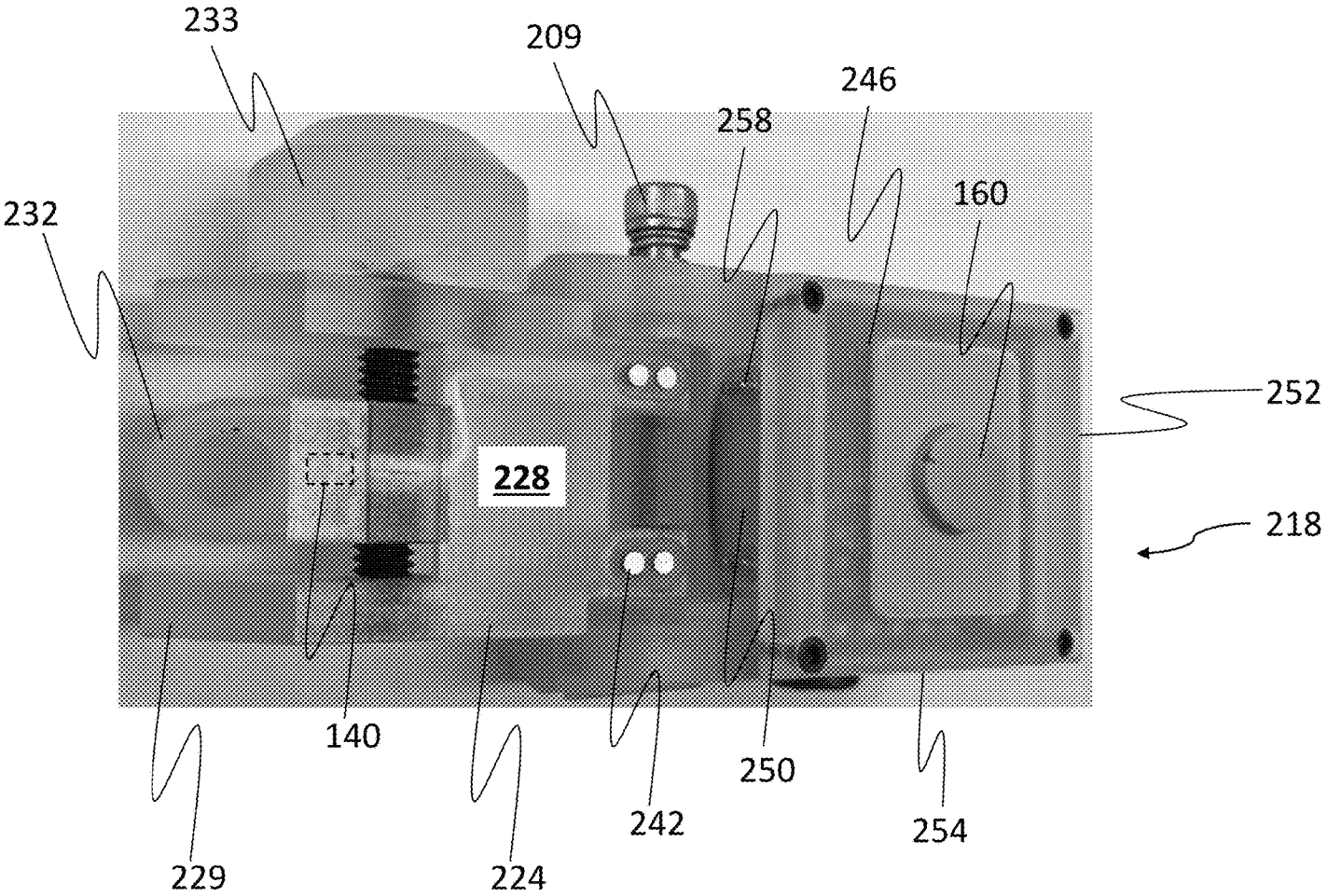
FIG. 3C shows a top down view of the rear sight assembly of FIG. 3A.
Figure 3D:
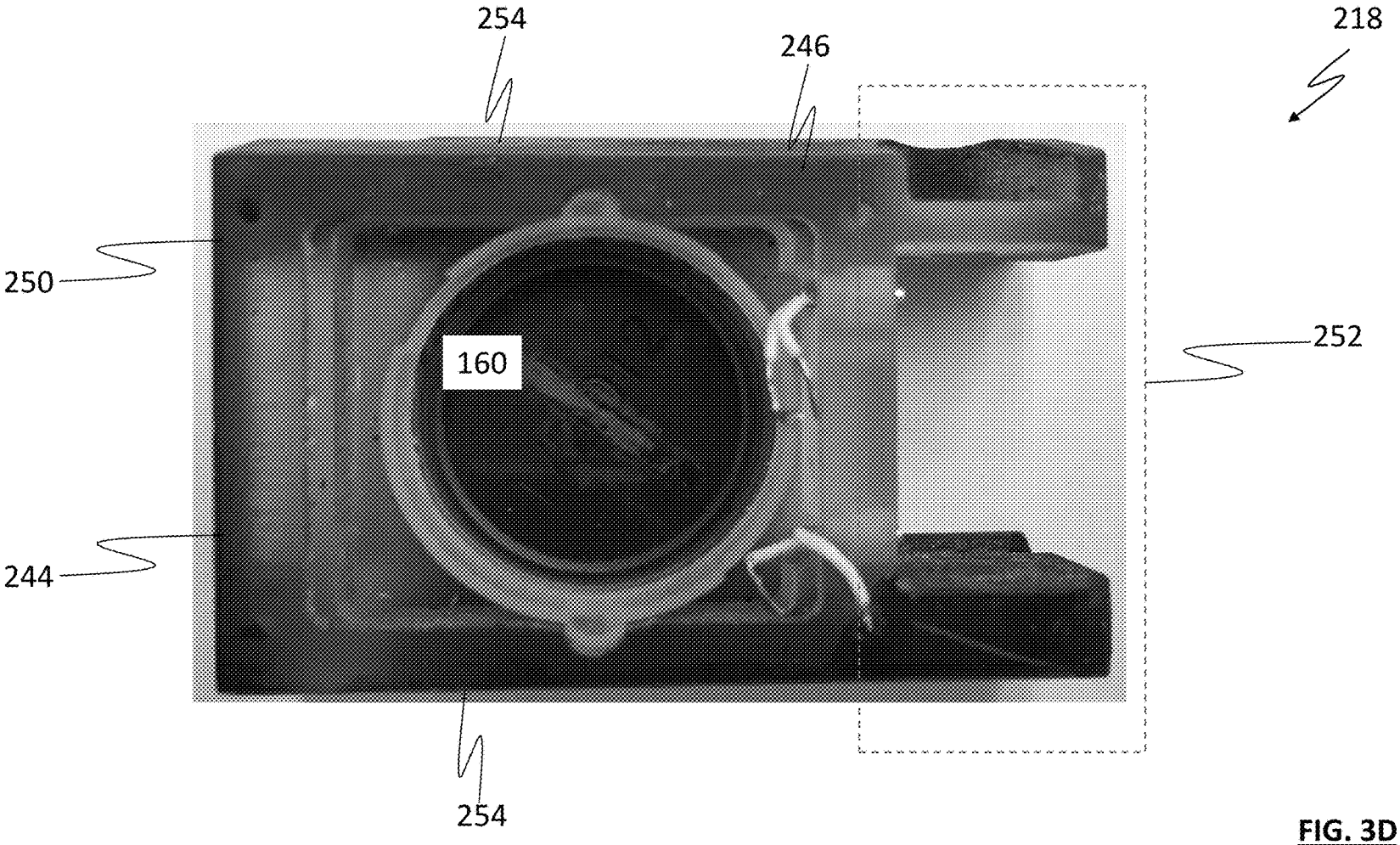
FIG. 3D shows a top down view of the rear base of the rear sight assembly of FIG. 3A.
Figure 3E:
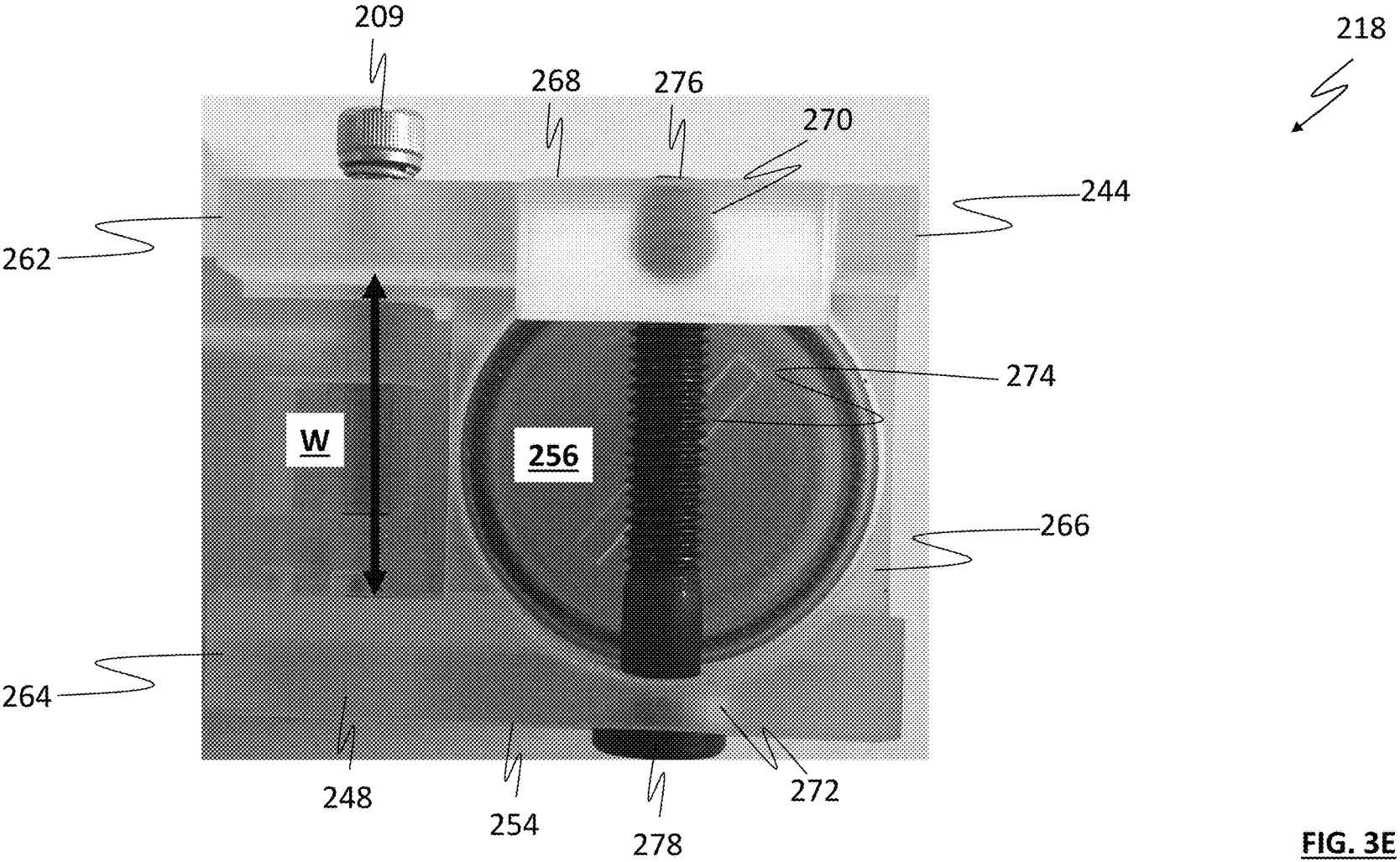
FIG. 3E shows a bottom up view of the rear base of the rear sight assembly of FIG. 3A.
Figure 3F:
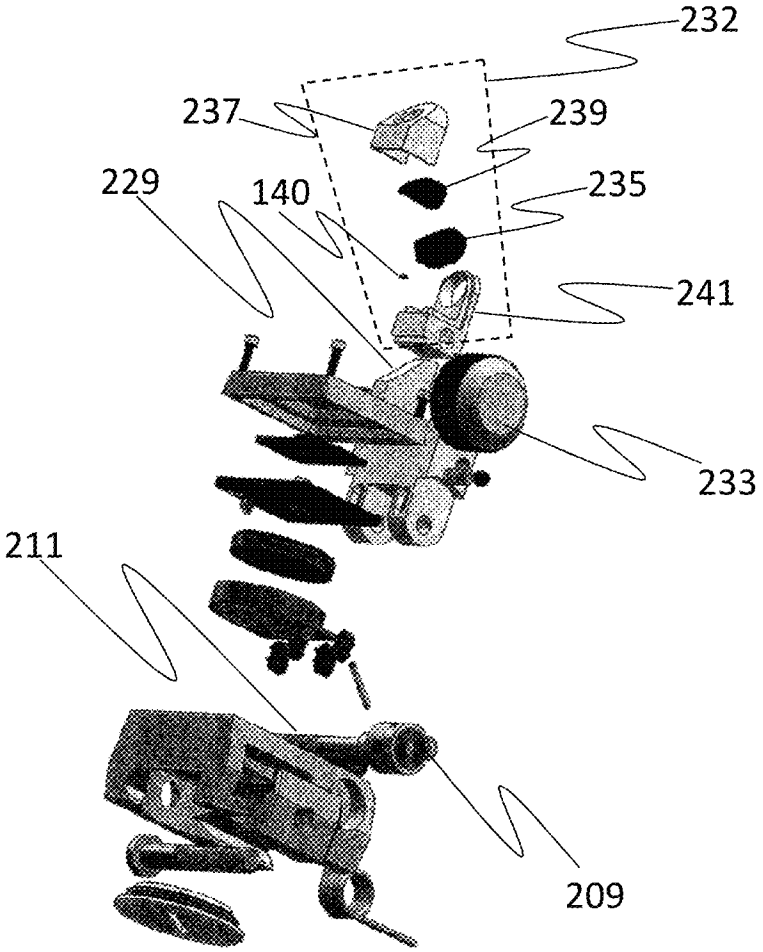
FIG. 3F shows an exploded view of the rear sight assembly of FIG. 3A.

In accordance with the present invention, a novel sighting system that is illuminated and configurable for use with weapons and other articles (such as laser targeting systems) is provided and disclose herein. It should be appreciated that the present invention can be configured to operate with unfolding sighting systems currently installed on modern military styled and popular hunting and target rifles. Additionally, if there is sufficient ambient light, the present invention is operable even if the illumination fails to operate Referring to FIG. 1A, FIG. 1B and FIG. 1C, an illuminated sighting system 100 is provided and includes a front sight 102 and a rear sight 104, wherein the front sight 102 and rear sight 104 are configured to securely and removably attach to a weapon 106 having a receiver 108, a barrel 110, a barrel muzzle 112 and a mounting rail 114 (such as a picatinny rail or a weaver rail). The mounting rail 114 is typically associated with the weapon 106 such that the mounting rail 114 extends along the top portion of the barrel 110 between the receiver 108 and the barrel muzzle 112. It should be appreciated that when the front sight 102 and rear sight 104 are associated with the mounting rail 114 of the weapon 106, the front sight 102 is located proximate to the barrel muzzle 112 and the rear sight 104 is located proximate to the receiver 108.

Referring to FIG. 2A, FIG. 2B, FIG. 2C, FIG. 2D, FIG. 2E and FIG. 2F, the front sight 102 includes a front aperture 116 and a front base 118, wherein the front aperture 116 is rotatably associated with the front base 118 to be configurable between a first configuration 120 and a second configuration 122. In one embodiment, the front aperture 116 is associated with the front base 118 via a pin lock mechanism 109 having a compression spring 111. Once the compression spring 111 is depressed, the front aperture 116 is configurable between the first configuration 120 and the second configuration 122. The front aperture 116 includes an aperture body 124 having a body top 123, a body bottom 125, a body front 126, a body rear 128, body sides 130 and a front sight post 132. The aperture body 124 defines an aperture cavity 134 and a threaded post cavity 136, wherein the aperture cavity 134 is communicated with the threaded post cavity 136. The front sight post 132 defines an LED cavity 133 and includes a threaded portion 138 which is configured to rotatingly associate with the threaded post cavity 136. This advantageously allows the front sight post 132 to be adjustable in height. In additional embodiments, it is contemplated that the front sight post 132 may not be adjustable or a small motor may be provided that allows the front sight post 132 to be adjustable electronically using the electronics in the front base 118. The front sight post 132 further includes a front aiming rod 131 and an LED 140, wherein the front aiming rod 131 is communicated with the LED cavity 133 and extends upward from the top of the front sight post 132 and wherein the LED 140 is located within the LED cavity 133 such that light from the LED 140 is incident on a portion of the front aiming rod 131 and is transmitted to the top of the front aiming rod 131.

It should be appreciated that the front aiming rod 131 is constructed to transmit light from the bottom of the front aiming rod 131 to the top of the front aiming rod 131, wherein the top of the front aiming rod 131 may be at least partially constructed from a translucent material (and/or a fiber optic material may be used) such that when the LED 140 is illuminated the top of the front aiming rod 131 is at least partially illuminated so that the user can see the light. Additionally, it should be appreciated that the front sight post 132 may be constructed from a metal and/or plastic material as desired. Furthermore, the aperture body 124 includes a plurality of aperture connector pads 142 located on the body rear 128 of the aperture body 124, wherein the plurality of aperture connector pads 142 are conductively connected to the LED 140 such that when a potential difference is present across the plurality of aperture connector pads 142 the LED 140 is powered to become illuminated. As mentioned briefly hereinbefore, the front aperture 116 is rotatably associated with the front base 118 to be configurable between a first configuration 120 and a second configuration 122. When in the first configuration 120, the aperture body 124 is in a 'stowed' position and is oriented to be substantially parallel with the barrel 110 of the weapon 106 and when in the second configuration 122 the aperture body 124 is in an 'unstowed' position and is oriented to be substantially perpendicular with the barrel 110 of the weapon 106. It is further contemplated that in additional embodiments, the front sight post 132 may define a front sight post cavity and that the LED 140 may be located within the front sight post cavity. It should be appreciated in other embodiments, the front aiming rod 131 may also be constructed (in whole or in part) from an electroluminescent material.

The front base 118 includes a base structure 144 having a base top 146, a base bottom 148, a base front 150, a base rear 152 and base sides 154, wherein the base structure 144 defines a base cavity 156 and wherein the base front 150 includes a plurality of base connector pads 158. The front base 118 further includes a battery 159, a power switch 160 and other electronic components located within the base cavity 156, wherein the power switch 160 is operable via an opening in the base top 146 and wherein the battery 158, the power switch 160 and the other electronic components are configured to controllably provide power to the plurality of base connector pads 158. It should be appreciated that the plurality of base connector pads 158 and the plurality of aperture connector pads 142 are located on the base front 150 and the body rear 128, respectively, such that when the aperture body 124 is configured in the second configuration 122 the plurality of base connector pads 158 and the plurality of aperture connector pads 142 are in contact with each other such that power is provided to the LED 140.

It should be appreciated that the base bottom 148 includes a first bottom rail 162 and a second bottom rail 164, wherein the first bottom rail 162 and second bottom rail 164 defines a bottom channel 166 which extends along the length of the base bottom 148 and which includes a bottom channel width W, wherein the bottom channel width W is sized and shaped to receive and/or contain the mounting rail 114. It should be appreciated that the first bottom rail 162 includes a movably adjustable rail portion 168 which defines a rail threaded cavity 170 and the second bottom rail 164 defines a screw head cavity 172. An adjusting screw 174 having a threaded screw portion 176 and a screw head 178 is provided wherein the screw head 178 is located within the screw head cavity 172 and the threaded screw portion 176 is located within the rail threaded cavity 170. This configuration advantageously allows the base bottom 148 to be secured to the mounting rail 114. When the mounting rail 114 is located within the bottom channel 166, the adjusting screw 174 can be rotated to cause the adjustable rail portion 168 to move toward the second bottom rail 164 thereby compressing onto the mounting rail 114 and securing the base bottom 148 and thus, the front sight 102 to the mounting rail 114.

Referring to FIG. 3A, FIG. 3B, FIG. 3C, FIG. 3D, FIG. 3E and FIG. 3F, the rear sight 104 includes a rear aperture 216 and a rear base 218, wherein the rear aperture 216 is rotatably associated with the rear base 218 to be configurable between a first configuration 220 and a second configuration 222. The rear aperture 216 includes a rear aperture body 224 having a rear body top 223, a rear body bottom 225, a rear body front 226, a rear body rear 228 and rear body sides 230, wherein the rear body top 223 includes rear body top posts 229 located on either side of the rear body top 223. In one embodiment, the rear aperture 216 is associated with the rear base 218 via a pin lock mechanism 209 having a compression spring 211. Once the compression spring 211 is depressed, the rear aperture 216 is configurable between the first configuration 220 and the second configuration 222. The rear aperture 216 further includes a rear sight reticle 232 and a reticle adjusting screw 233, wherein the reticle adjusting screw 233 is movably associated with the rear body top posts 229 and the rear sight reticle 232 to allow the rear sight reticle 232 to be movably adjustable between the rear body top posts 229. This advantageously allows the rear sight reticle 232 to be laterally adjustable between the rear body top posts 229. In additional embodiments, it is contemplated that the rear sight reticle 232 may not be adjustable or a small motor may be provided that allows the rear sight reticle 232 to be adjustable electronically using the electronics in the rear base 218.

Additionally, the rear sight reticle 232 defines a reticle cavity 234 and includes a sighting "halo" or circle 235, wherein the sighting circle 235 is at least partially surrounded by a translucent or a fiber optic material which is communicated with the reticle cavity 234. It should be appreciated in other embodiments, the sighting circle 235, or "halo", may be constructed from or incorporate OLEDS and/or an electroluminescent material.

Referring again to FIG. 3F, in one embodiment the rear sight reticle 232 includes a reticle shroud 237, a halo center insert cover 239, the illuminatable sighting "halo" or circle 235, an LED 140 and a reticle body 241. When assembled together, the LED 140 is located within the reticle body 241 and the light from the LED 140 is transmitted (via the sighting "halo" or circle 235 material) to the sighting "halo" or circle 235 such that the sighting "halo" or circle 235 is illuminated. The a reticle shroud 237 and/or halo center insert cover 239 allows a user to see the illuminated sighting "halo" or circle 235 but prevents a target from seeing the light from the illuminated sighting "halo" or circle 235.

It should be appreciated that the rear aperture 216 further includes an LED 140 located within the reticle cavity 234 such that when the LED 140 is illuminated the sighting circle 235 is at least partially illuminated. Additionally, the rear aperture body 224 includes a plurality of rear aperture connector pads 242 located on the rear body rear 228 of the rear aperture body 224, wherein the plurality of rear aperture connector pads 242 are conductively connected to the LED 140 such that when a potential difference is present across the plurality of rear aperture connector pads 242 the LED 140 is powered to become illuminated. As mentioned briefly hereinbefore, the rear aperture 216 is rotatably associated with the rear base 218 to be configurable between a first configuration 220 and a second configuration 222. When in the first configuration 220, the rear aperture body 224 is in a 'stowed' position and is oriented to be substantially parallel with the barrel 110 of the weapon 106 and when in the second configuration 222 the rear aperture body 224 is in an 'unstowed' position and is oriented to be substantially perpendicular with the barrel 110 of the weapon 106.

The rear base 218 includes a rear base structure 244 having a rear base top 246, a rear base bottom 248, a rear base front 250, a rear base rear 252 and rear base sides 254, wherein the rear base structure 244 defines a rear base cavity 256 and wherein the rear base front 250 includes a plurality of rear base connector pads 258. The rear base 218 further includes a battery 159, a power switch 160 and other electronic components located within the rear base cavity 256, wherein the power switch 160 is operable via an opening in the rear base top 246 and wherein the battery 159, the power switch 160 and the other electronic components are configured to controllably provide power to the plurality of rear base connector pads 258. It should be appreciated that the plurality of rear base connector pads 258 and the plurality of rear aperture connector pads 242 are located on the rear base front 250 and the rear body rear 228, respectively, such that when the rear aperture body 224 is configured in the second configuration 222 the plurality of rear base connector pads 258 and the plurality of rear aperture connector pads 242 are in contact with each other such that power is provided to the LED 140.

It should be appreciated that the rear base bottom 248 includes a first bottom rail 262 and a second bottom rail 264, wherein the first bottom rail 262 and second bottom rail 264 defines a bottom channel 266 which extends along the length of the base bottom 248 and which includes a bottom channel width W, wherein the bottom channel width W is sized and shaped to receive and/or contain the mounting rail 114. It should be appreciated that the first bottom rail 262 includes a movably adjustable rail portion 268 which defines a rail threaded cavity 270 and the second bottom rail 264 defines a screw head cavity 272. An adjusting screw 274 having a threaded screw portion 276 and a screw head 278 is provided wherein the screw head 278 is located within the screw head cavity 272 and the threaded screw portion 276 is located within the rail threaded cavity 270. This configuration advantageously allows the base bottom 248 to be secured to the mounting rail 114. When the mounting rail 114 is located within the bottom channel 266, the adjusting screw 274 can be rotated to cause the adjustable rail portion 268 to move toward the second bottom rail 264 thereby compressing onto the mounting rail 114 and securing the base bottom 248 and thus, the front sight 102 to the mounting rail 114.

It should be appreciated that in other embodiments, the front sight 102 and/or rear sight 104 may be secured to the mounting rail 114 using any type of securing configuration/device suitable to the desired end purpose. For example, the front sight 102 and/or rear sight 104 may be configured as a quick disconnect mounting clamp and/or compression claims.

Figure 4:
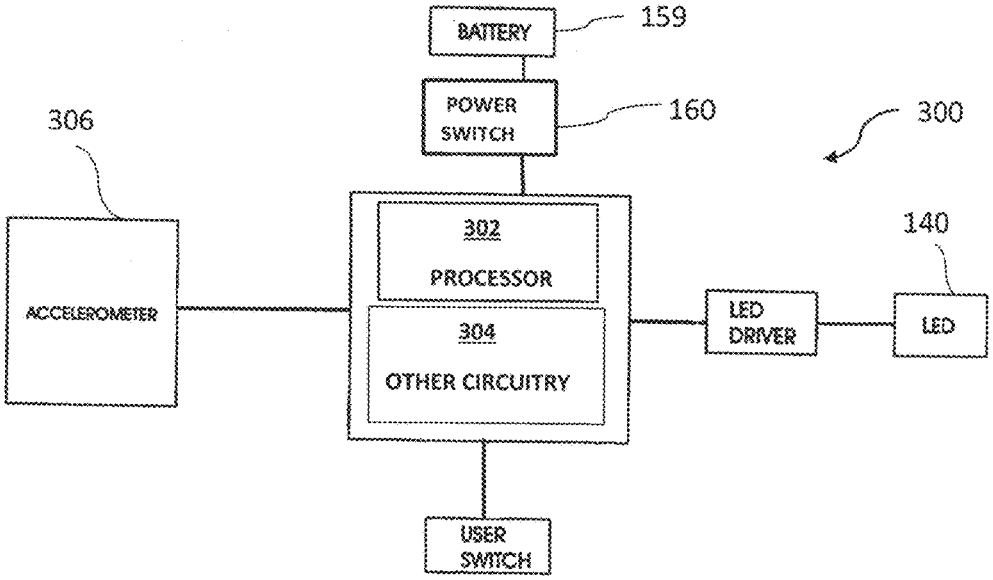
FIG. 4 shows a schematic block diagram of control circuitry that may be used to control the rear and front sights of FIG. 2 and FIG. 3, in accordance with one embodiment of the invention.

Referring to FIG. 4, it should be appreciated that the front sight 102 and/or rear sight 104 may also contain control circuitry 300 which may include a processor 302 (or other type of control device) and other circuitry 304 to control at least a portion of the operation of the front sight 102 and/or rear sight 104. It is contemplated that in some embodiments, the front sight 102 and/or rear sight 104 may include various sensors, such as a light sensor (and other circuitry 304) to sense low light level conditions and/or an accelerometer 306 (and other circuitry 304) to sense the movement/orientation of the weapon 106, wherein the light sensor and/or accelerometer 306 may be communicated with the processor 302. This would allow the processor 302 to automatically control and/or regulate the activity of the LEDs 140. For example, in low light level conditions, the power to and/or the intensity of the LED may be controlled. In other embodiments, the user may simply control the LEDs 140 by activating the power switch 160 and adjusting the intensity via the power switch 160.

Figure 5:
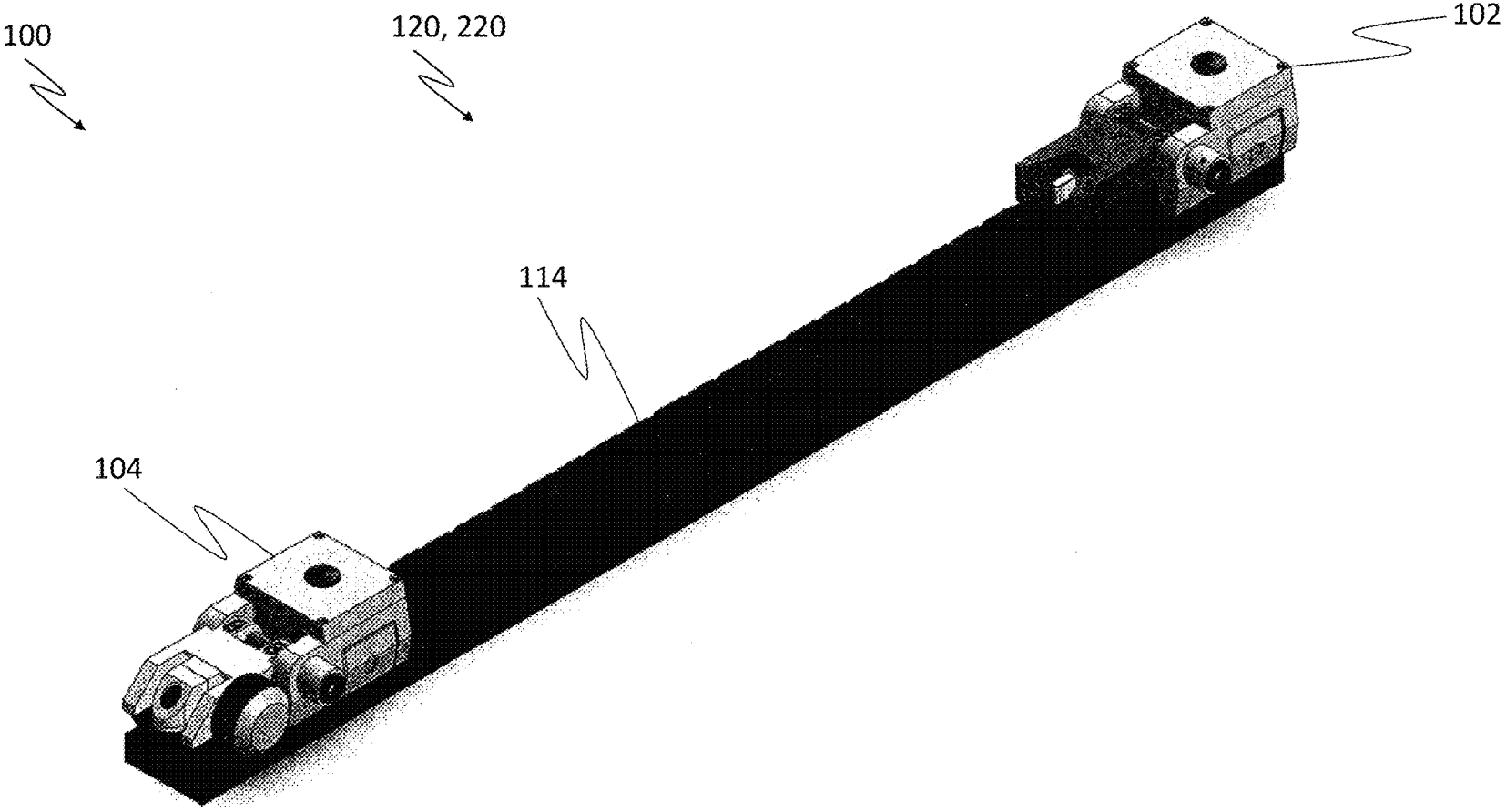
FIG. 5 shows the front sight assembly of FIG. 2 and the rear sight assembly of FIG. 3 configured in a stowed configuration mounted to the mounting rail of FIG. 1C, in accordance with one embodiment of the invention.
Figure 6:
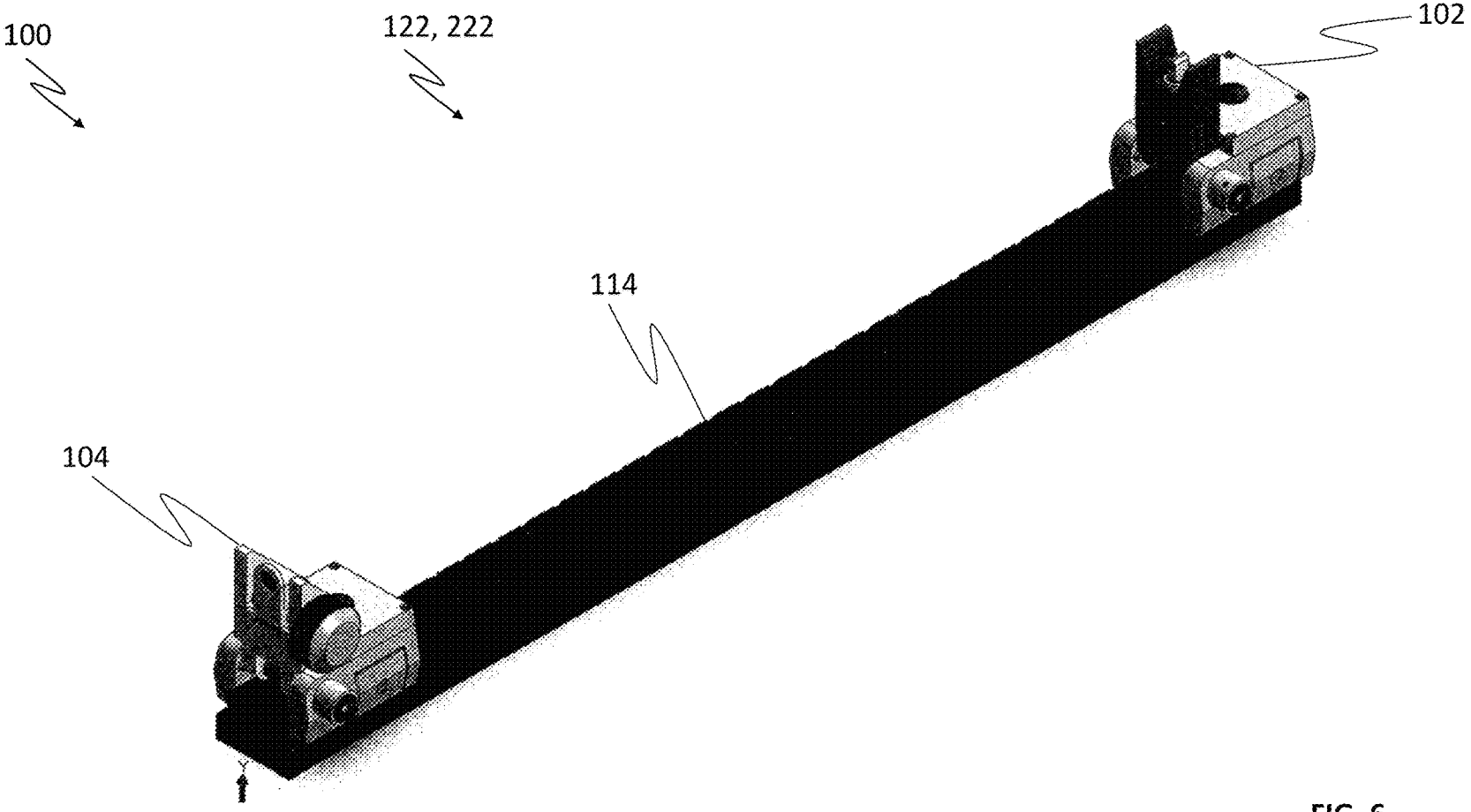
FIG. 6 shows the front sight assembly of FIG. 2 and the rear sight assembly of FIG. 3 configured in an un-stowed configuration mounted to the mounting rail of FIG. 1C, in accordance with one embodiment of the invention.

Referring to FIG. 5, the front sight 102 and rear sight 104 are shown securely connected to a mounting rail 114, wherein both the front aperture 116 and rear aperture 216 are shown in the first configuration 120, 220 (or 'stowed' configuration). Referring to FIG. 6, the rear sight 102 and rear sight 104 are shown securely connected to a mounting rail 114, wherein both the front aperture 116 and rear aperture 216 are shown in the second configuration 122, 222 (or 'unstowed' configuration).

It should be appreciated that although the aperture connector pads 142, 242 and base connector pads 158, 258 are disclosed herein as being contact pads, it is contemplated that other electrical connections may be used. For example, in one embodiment, the front aperture 116 and rear aperture 216 may be hard-wired to electronics contained in the front base 118 and rear base 218, respectively. In another embodiment, it is contemplated that the electronics that control the LED 140 may be contained within the front aperture 116 and rear aperture 216. Thus, no electrical connection between the front aperture 116 and rear aperture 216 and the front base 118 and rear base 218, respectively, may be needed. It should also be appreciated that the LED 140 used in the front sight 102 may be of the same or different color than the LED 140 used in the rear sight 104, as desired. For example, in one embodiment, the LED 140 used in the front sight 102 may be a red LED, while the LED 140 used in the rear sight 104 may be a green LED. Additionally, it should be appreciated that the front sight 102 and rear sight 104 are configured such that only the user (i.e. the operator of the weapon 106) will be able to see the light being emitted from the front sight 102 and rear sight 104. As such, when the weapon 106 is being aimed, the target will not be able to see the lights and thus not be able to locate the weapon 106.

In accordance with other embodiments of the invention, it should be appreciated that the invention is not limited to the sighting "halo" and front sight post arrangement as discussed hereinabove. It is contemplated that the front aperture 116 and/or rear aperture 216 may be of any configuration suitable to the desired end purpose, where at least a portion of the front aperture 116 and/or rear aperture 216 are illuminated. For example, in one embodiment the front and/or rear apertures 116, 216, respectively, may be round with two or three illuminated dots at the 3, 6 and 9 o'clock positions. In another embodiment, the front and/or rear apertures 116, 216, respectively, may be "V" shaped with illuminated dots on either side of the "V." Moreover, it is contemplated that a flashlight and/or a LASER may be integrated into the front sight 102 to allow for additional and/or separate aiming/illumination capabilities. Additionally, it is contemplated that the front sight 102 and/or rear sight 104 may be sealed for use under water or in wet conditions. Moreover, it is contemplated that infrared LEDs may be used to allow the illuminated sighting system 100 to be compatible with night vision technology.

It should be appreciated that, in one embodiment, the illuminated sighting system 100 of the present invention may be operated by configuring the front sight 102 and rear sight 104 from the first configuration 120, 220 respectively (i.e. stowed) into the second configuration 122, 222 respectively (i.e. unstowed). The LEDs 140 in the front sight 102 and rear sight 104 are powered to cause the LEDs 140 to light the aiming rod 131 and the sighting halo 235. The operator then aligns the weapon 106 such that the target is in line with the aiming rod 131 and visible through the sighting halo 235. It should be appreciated that the illuminated aiming rod 131 and the illuminated sighting halo 235 work together to focus the aim of the operator onto the target. The operator may then engage the target. When the target has been engaged, the front sight 102 and rear sight 104 may be configured from the second configuration 122, 222 respectively (i.e. unstowed) into the first configuration 120, 220 respectively (i.e. stowed) until needed.

It should be appreciated that while the invention has been described with reference to an exemplary embodiment, it will be understood by those skilled in the art that various changes, omissions and/or additions may be made and equivalents may be substituted for elements thereof without departing from the spirit and scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

What is claimed is:

1. An illuminated sighting system, comprising:

a front sight having a front aperture and a front base, wherein, the front aperture includes a front connector pad, a front LED, a front sight post and an aperture body defining an aperture cavity, wherein the front connector pad is electrically connected to the front LED and wherein the front LED is located within the aperture cavity and wherein the front sight post is movably associated with the aperture body to be adjustable in height and to be optically communicated with the front LED such that when the front LED is illuminated, at least a portion of the front sight post is illuminated, and wherein, the front base includes a front base structure having a front base connector pad and defining a front base cavity for containing front base power and control circuitry, wherein the front base connector pad is electrically connected to the front base power and control circuitry, wherein the front sight is configurable between a first configuration and a second configuration, and wherein when the front sight is in the first configuration the front aperture is in a stowed position and when the front sight is in the second configuration the front aperture is in an unstowed configuration and the front connector pad is contacting the front base connector pad; and a rear sight having a rear aperture and a rear base, wherein, the rear aperture includes a rear connector pad, a rear LED, a rear aperture body and a rear sight reticle defining a reticle cavity and having a sighting halo, wherein the rear connector pad is electrically connected to the rear LED and wherein the rear LED is located within the reticle cavity and wherein the rear sight reticle is movably associated with the aperture body to be laterally adjustable and to be optically communicated with the rear LED such that when the rear LED is illuminated, at least a portion of the sighting halo is illuminated, and wherein, the rear base includes a rear base structure having a rear base connector pad and defining a rear base cavity for containing rear base power and control circuitry, wherein the rear base connector pad is electrically connected to the rear base power and control circuitry, wherein the rear sight is configurable between a first configuration and a second configuration, and wherein when the rear sight is in the first configuration the rear aperture is in a stowed position and when the rear sight is in the second configuration the rear aperture is in an unstowed configuration and the rear connector pad is contacting the rear base connector pad.

2. The illuminated sighting system of claim 1, wherein the front base structure includes a front base bottom, wherein the front base bottom is configured to securely and adjustably associate with a mounting rail of a weapon.

3. The illuminated sighting system of claim 1, wherein the rear base structure includes a rear base bottom, wherein the rear base bottom is configured to securely and adjustably associate with a mounting rail of a weapon.

4. The illuminated sighting system of claim 1, wherein the front aperture is rotatably associated with the front base to be configurable between the first configuration and second configuration.

5. The illuminated sighting system of claim 1, wherein the rear aperture is rotatably associated with the rear base to be configurable between the first configuration and second configuration.

6. The illuminated sighting system of claim 1, wherein the front base power and control circuitry includes a battery, a power switch and a processor configured to control the operation of the front LED.

7. The illuminated sighting system of claim 1, wherein the rear base power and control circuitry includes a battery, a power switch and a processor configured to control the operation of the rear LED.

8. The illuminated sighting system of claim 3, wherein the rear aperture is rotatably associated with the rear base to be configurable between the first configuration and second configuration.

9. The illuminated sighting system of claim 2, wherein the front base power and control circuitry includes a battery, a power switch and a processor configured to control the operation of the front LED.

10. The illuminated sighting system of claim 3, wherein the rear base power and control circuitry includes a battery, a power switch and a processor configured to control the operation of the rear LED.

* * * * *